US012751539B2

(12) United States Patent
Sipes

(10) Patent No.: US 12,751,539 B2
(45) Date of Patent: Oct. 6, 2026

(54) TOOL LANYARD

(71) Applicant: Joshua Sipes, Magnolia, TX (US)

(72) Inventor: Joshua Sipes, Magnolia, TX (US)

( * ) Notice: Subject to any disclaimer, the term of this patent is extended or adjusted under 35 U.S.C. 154(b) by 94 days.

(21) Appl. No.: 18/679,422

(22) Filed: May 30, 2024

(65) Prior Publication Data

US 2025/0366598 A1 Dec. 4, 2025

(51) Int. Cl.
*A45F 5/00* (2006.01)

(52) U.S. Cl.
CPC ..... *A45F 5/00* (2013.01); *A45F 2005/006* (2013.01); *A45F 5/1575* (2025.01)

(58) Field of Classification Search
CPC .. A45F 2005/006; A45F 5/021; A45F 5/1575; A62B 1/16; Y10T 24/1397
See application file for complete search history.

(56) References Cited

U.S. PATENT DOCUMENTS 3,967,407 A * 7/1976 Halbasch ..... A01K 93/00 43/44.9
5,019,000 A * 5/1991 Stephens ..... B63B 22/00 441/6
5,435,094 A * 7/1995 Howard ..... A01K 91/08 43/44.9
5,600,873 A * 2/1997 May ..... G02C 11/02 24/3.13
6,216,319 B1 * 4/2001 Elkins ..... A45F 5/00 224/904
7,032,529 B2 * 4/2006 Sanford ..... F16F 7/006 482/121
7,762,860 B2 * 7/2010 Reed ..... B63B 22/24 441/23
7,797,876 B2 * 9/2010 McKelvey ..... A01K 91/10 43/43.11
8,562,450 B2 * 10/2013 Gormley ..... A63B 43/007 473/146
10,716,390 B2 * 7/2020 Wagner ..... A45F 5/00
11,510,482 B2 * 11/2022 Holland ..... A45F 5/00
11,819,094 B2 * 11/2023 Allevato, III ..... B63B 32/45
11,911,889 B1 * 2/2024 Pascua ..... A45F 5/021
2006/0272890 A1 * 12/2006 Harmon ..... A45F 5/021 182/3
2012/0267403 A1 * 10/2012 Ward, Jr. ..... A45F 5/00 224/219
2012/0311827 A1 * 12/2012 Wilson ..... A45F 5/10 24/304
2013/0299541 A1 * 11/2013 Dickison ..... A45F 5/00 224/191
2025/0108897 A1 * 4/2025 Lundgren ..... B63H 16/067

* cited by examiner

*Primary Examiner* — Adam J Waggenspack
(74) *Attorney, Agent, or Firm* — Ashurst Perkins Coie US LLP

(57) ABSTRACT

Techniques that relate to a tool lanyard for securing a tool in position are disclosed. In one example aspect, the tool lanyard includes a shock cord having a first end and a second end. The tool lanyard also includes a spring clip configured to attach to the shock cord via a first hollow opening of the first end of the shock cord, wherein the spring clip enables securing the tool lanyard to a loop. The tool lanyard also includes a swivel with a first ring and a second ring on each end, wherein the swivel is configured to attach to the shock cord by coupling the first ring to a second hollow opening of the second end of the shock cord, and wherein the tool is configured to be secured to the tool lanyard via the second ring.

11 Claims, 5 Drawing Sheets

TOOL LANYARD

TECHNICAL FIELD

The present invention relates to a tool lanyard to secure a metal detector pinpointer in position.

BACKGROUND

A lanyard is a length of cord or strap that can serve various functions, including a means of attachment, restraint, retrieval, activation, and deactivation. A lanyard is designed to help a wearer of the lanyard keep and use equipment attached to the lanyard. Lanyards are widely used with small devices to prevent loss or dropping and generally have a loop of thread on an end that is attached to the small devices.

BRIEF DESCRIPTION OF THE DRAWINGS

Detailed descriptions of implementations of the present invention will be described and explained through the use of the accompanying drawings.

Figure 1:
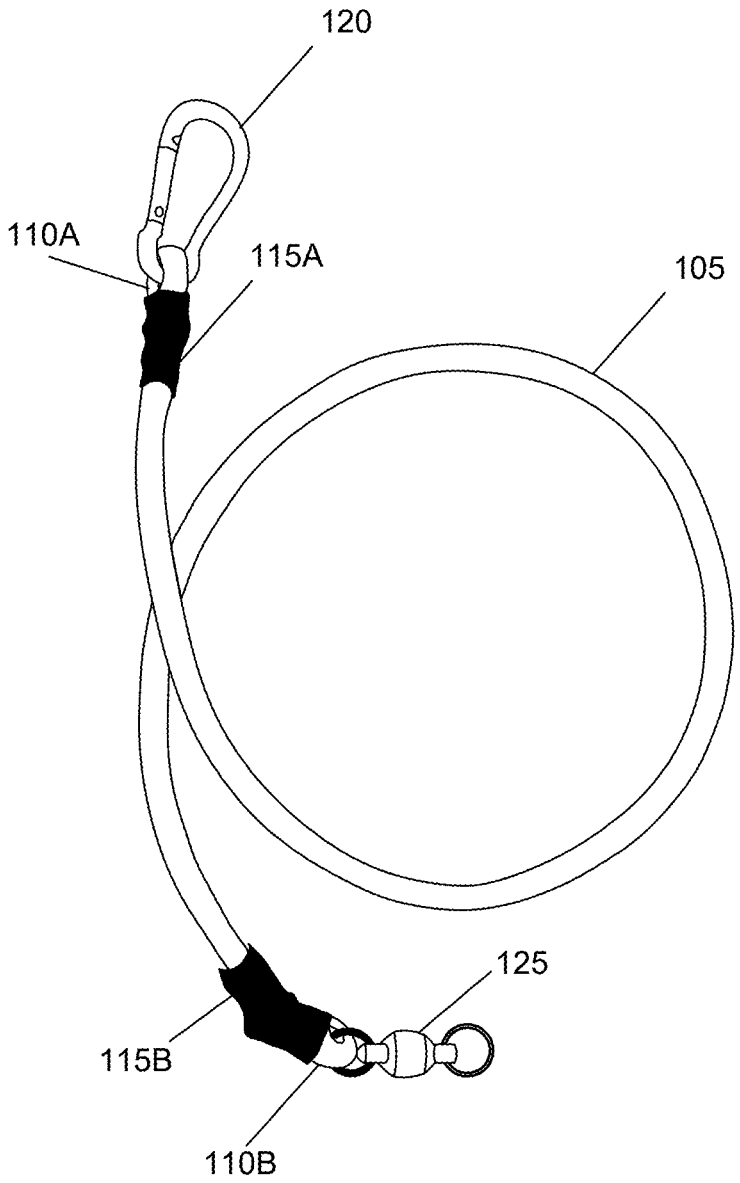
FIG. 1 is one example of a structural diagram that illustrates a layout of a tool lanyard according to one or more embodiments of the present technology.

The technologies described herein will become more apparent to those skilled in the art from studying the Detailed Description in conjunction with the drawings. Embodiments or implementations describing aspects of the invention are illustrated by way of example, and the same references can indicate similar elements. While the drawings depict various implementations for the purpose of illustration, those skilled in the art will recognize that alternative implementations can be employed without departing from the principles of the present technologies. Accordingly, while specific implementations are shown in the drawings, the technology is amenable to various modifications.

This disclosure provides certain details for a thorough understanding and enabling description of these examples. One skilled in the relevant technology will understand, however, that the invention can be practiced without many of these details. Likewise, one skilled in the relevant technology will understand that the invention can include well-known structures or features that are not shown or described in detail to avoid unnecessarily obscuring the descriptions of examples.

DETAILED DESCRIPTION

Metal detectors are instruments that detect nearby presence of metal and are useful for finding metal objects on a surface, underground, and underwater. Metal detectors vary in size depending on the intended use. For example, portable metal detectors often used by archaeologists and treasure hunters to locate metallic items, such as jewelry, coins, clothes are designed to be worn by an individual and include long metal rods that are used to detect metal objects. Similarly, military standard metal detectors used to detect land mines are designed such that the wearer of the metal detector is positioned away from the detected land mines.

In contrast, metal detector pinpointers used by hobbyists and other individuals to detect metal objects in public places, such as parks, beaches, underwater, etc., are smaller and designed to be held in one hand. Such metal detector pinpointers are often attached to tool lanyards designed to enable wearers to secure the metal detector pinpointers in position by attaching to the wearer around the wearer's body, such as at a belt, around the shoulder, or around the wrist. Common problems with conventional tool lanyards include twist and entanglement from day-to-day use, as well as snag or fray from ordinary use or corrosion from underwater use.

The disclosed technology addresses such problems by introducing a tool lanyard that enables securing a metal detector pinpointer in position by utilizing a shock cord to prevent twist or tangle and establish connection between the metal detector pinpointer and a loop. The tool lanyard includes multiple components, including a shock cord configured to extend when stretched and return to original length upon release, a spring clip configured to attached to one end of the shock cord, and a ball-bearing swivel configured to attach to the other end of the shock cord. The tool lanyard can also be used together with other tools to enable easy retrieval and to reduce or eliminate entanglement in daily uses.

In one example aspect, a tool lanyard for securing a tool in position is disclosed. The tool lanyard comprises a shock cord having a first end and a second end, and a spring clip configured to attach to the shock cord. The shock cord is configured to extend when one end is stretched from another end and return to original length upon release. The first end of the shock cord includes a first hollow opening and a first stainless-steel hog ring that is coupled to the first end of the shock cord (e.g., fixedly or removably attached to the first end of the shock cord). In some embodiments, the first end of the shock cord can be covered by a first adhesive shrink wrap. The second end of the shock cord includes a second hollow opening and a second stainless-steel hog ring that is coupled to the second end of the shock cord. In some embodiments, the second end of the shock cord can be covered by a second adhesive shrink wrap. The spring clip is attached to the shock cord via the first hollow opening. The spring clip enables securing the tool lanyard to a loop. The tool lanyard also includes a ball-bearing swivel with first and second split rings on each end. The ball-bearing swivel is configured to attach to the shock cord by fixedly attaching the first split ring to the second hollow opening, and the second split ring enables securing the metal detector pinpointer to the tool lanyard.

FIG. 1 is one example of a structural diagram that illustrates a layout of a tool lanyard according to one or more embodiments of the present technology. As shown in FIG. 1, the tool lanyard includes multiple components including a shock cord 105 having a first end 110A and a second end 110B. In some embodiments, the shock cord 105 is configured to have a diameter of 3/16 inches and a length between 18 to 28 inches. In other embodiments where a tool being attached to the tool lanyard is smaller or larger, the diameter of the shock cord 105 may vary. For example, a larger tool being attached to the tool lanyard may require a shock cord with greater diameter, such as ½ inches or ¾ inches. The diameter varies based on the size of the tool being attached in order to prevent jolting and damaging the attached tool. The wide range of length of the shock cord 105 available to a user enables the user to choose an appropriate length based on the size of the user and intended application of the attached tool.

The shock cord is configured to extend when one end is stretched from another end and return to original length upon release. Each end of the shock cord 105 includes a hollow opening. The hollow openings allow both ends of the shock cord to be coupled to other components of the lanyard tool, such as a spring clip 120 and/or a swivel 125. In some embodiments, each hollow opening of the first and second ends 110A-B is secured using a ½ inch diameter hog ring that ensures that the openings are wide enough for objects to pass through. The size of the hog ring that are used to secure the hollow openings varies depending on an object that penetrates through the hollow openings.

The tool lanyard includes the spring clip 120 configured to attach to the shock cord via the hollow opening of the first end 110A. The spring clip 120 is also known as a spring snap. The spring clip 120 enables securing of the tool lanyard to an object with a loop or hole. For example, the spring clip 120 can be used to attach the tool lanyard to a belt loop of a user. In a preferred embodiment, the spring clip 120 is made of stainless steel for durability. Alternatively, or in addition, other types of securing mechanisms, such as snap hooks or clips, trigger snaps, bolt snaps, can also be used to secure the tool lanyard to one or more objects.

In some embodiments, the hollow opening of the first end 110A is partially or entirely covered by an adhesive shrink wrap 115A. The adhesive shrink wrap 115A can be configured to wrap around the hollow opening of the first end 110A to create a hermetic seal and thus prevent passage of air, oxygen or other gases, and in some embodiments, liquids. In some embodiments, the adhesive shrink wrap 115A is a marine grade adhesive shrink wrap configured to further prevent snagging and fraying while minimizing corrosion due to daily use and/or underwater use.

The tool lanyard also includes the swivel 125 (e.g., a ball-bearing swivel). In some embodiments, a ball-bearing swivel with split rings on each end can be used. Other types of swivels, such as double-eye swivels or barrel swivels, can also be used. In the example shown in FIG. 1, the ball-bearing swivel 125 is configured to attach to the shock cord 105 by coupling one of the split rings to a hollow opening of the second end 110B of the shock cord 105. The other split ring is configured to be coupled to a tool, such as a metal detector pinpointer. By attaching the other split ring to the metal detector pinpointer, a secure connection can be established between the shock cord 105 and the metal detector pinpointer.

The purpose of the swivel 125 is to enable unhindered movement of the attached metal detector pinpointer without twisting or tangling the tool lanyard. The connection between the user and the spring clip 120 combined with the use of the shock cord 105 results in a single point of rotation at the metal detector pinpointer, allowing the user to use the metal detector pinpointer without twisting or tangling the tool lanyard.

In some embodiments, the hollow opening of the second end 110B is partially or entirely covered by an adhesive shrink wrap 115B. The adhesive shrink wrap 115B can be configured to wrap around the hollow opening of the first end 110B to create a hermetic seal and thus prevent passage of air, oxygen or other gases, and in some embodiments, liquids. In some embodiments, the adhesive shrink wrap 115B is a marine grade adhesive shrink wrap configured to further prevent snagging and fraying while minimizing corrosion due to daily use and/or underwater use.

Figure 2:
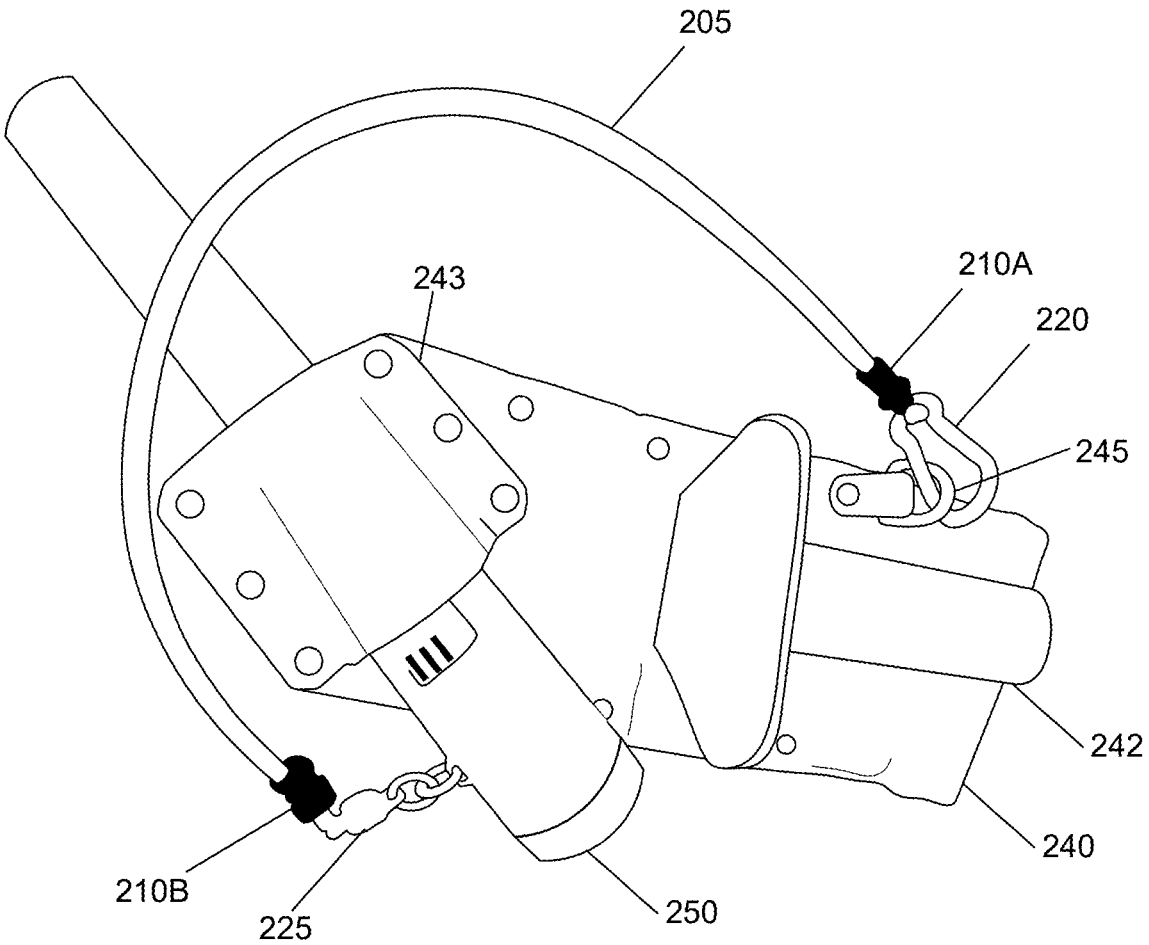
FIG. 2 is a structural diagram that illustrates a connection between the metal detector pinpointer and the tool lanyard, according to some implementations.

FIG. 2 is a structural diagram that illustrates a connection between the metal detector pinpointer and the tool lanyard, according to some implementations. As explained with respect to FIG. 1 above, the tool lanyard can include a shock cord 205 with first and second ends 210A-B, a spring clip 220 installed and attached to the shock cord 205 via a hollow opening of the first end 210A, and a ball-bearing swivel 225 installed and attached to the shock cord 205 via a hollow opening of the second end 210B. As illustrated in FIG. 2, in some embodiments, the hollow openings of the first and second ends 210A-B are entirely covered by an adhesive shrink wrap to prevent passage of gases and/or liquids for increased durability of components.

The tool lanyard can be installed and coupled to any loop or hole, such as a loop 245 of a digger sheath 240 as shown in FIG. 2. The digger sheath 240 can be attached to a user's body via a belt loop and can include a digging tool 242 and a tool pouch 243 configured to hold the hand-held tool, such as a metal detector pinpointer 250 of FIG. 2. The length of the shock cord 205 varies between 18 to 28 inches, enabling the user to secure the metal detector pinpointer 250 with ease and ensuring the metal detector pinpointer 250 is within reach of the user.

The ball-bearing swivel 225 is utilized to secure a connection between the tool lanyard and the metal detector pinpointer 250. The ball-bearing swivel 225 enables the user to move the metal detector pinpointer 250 freely without twists and ensures smooth rotation of the metal detector pinpointer 250 under pressure or underwater. FIG. 2 focuses on an application scenario of a metal detector pinpointer 250, but the tool lanyard can be used with various types of tools.

Figure 3:
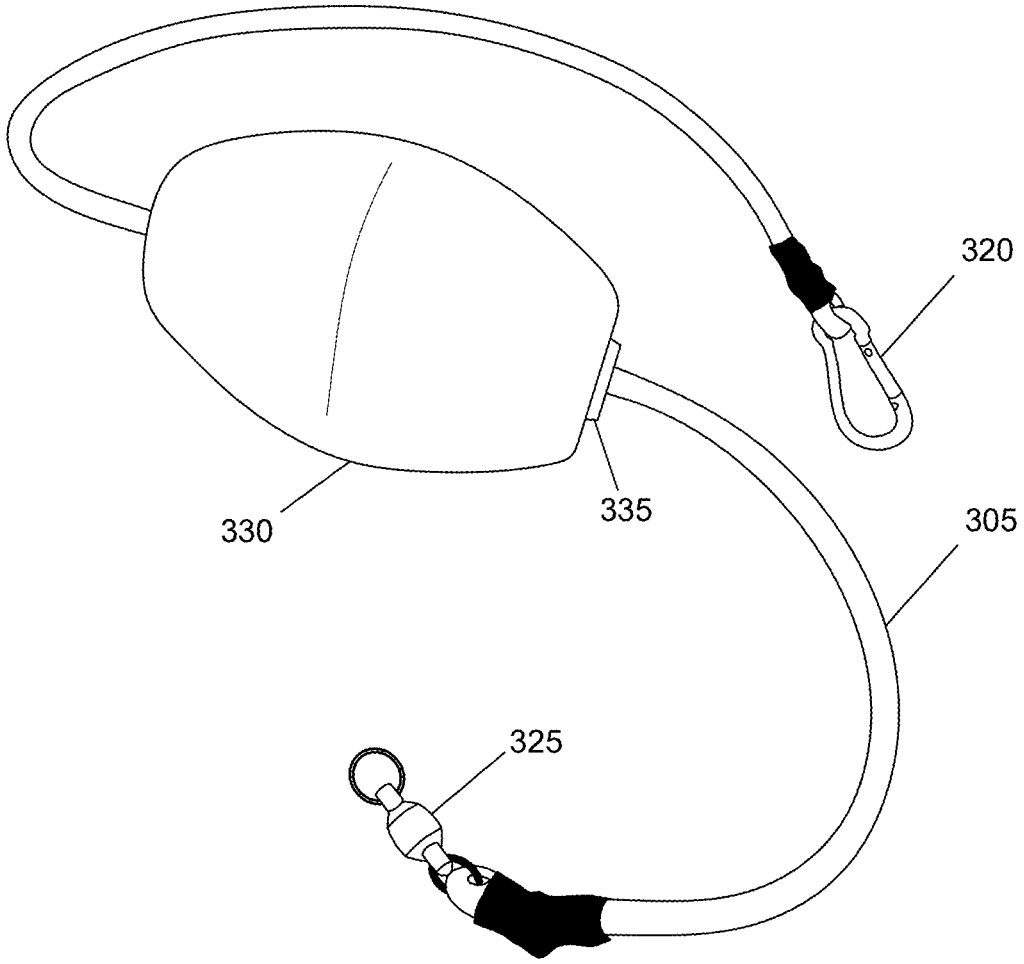
FIG. 3 is a diagram that illustrates a perspective view of the tool lanyard with a flotation device, according to some implementations.

FIG. 3 is a diagram that illustrates a perspective view of the tool lanyard with a flotation device, according to some implementations. In some circumstances, an underwater use of a tool may be desired by a wearer of the tool lanyard. For example, the wearer may want to use a metal detector pinpointer underwater to detect hidden metal objects on the ocean floor. As another example, the wearer may want to connect to a floating container for underwater fishing. The tool lanyard depicted in FIG. 3 includes a flotation device 330 which can be attached to the tool lanyard via a cylindrical hole of the flotation device 330 through which a shock cord 305 of the tool lanyard can be placed. The position of the flotation device 330 relative to the shock cord 305 can be adjusted by moving the flotation device along the shock cord 305. In some embodiments, a neoprene plug 335 is placed on each end of the cylindrical hole of the flotation device 330 to limit flow of water into the body of the flotation device 330.

When the wearer of the tool lanyard is operating underwater, the flotation device 330 enables the wearer to access the tool (e.g., the metal detector pinpointer or the floating container) without difficulty. For example, when the wearer loses hold of the metal detector pinpointer underwater, trapped air inside the flotation device 330 naturally enables the flotation device 330 to float up, shifting the flotation device 330 closer to the end of the shock cord 305 with the ball-bearing swivel 325. The shifting of the flotation device 330 ensures the position of the metal detector pinpointer is above a connection point between a spring snap 320 and the wearer.

Figure 4:
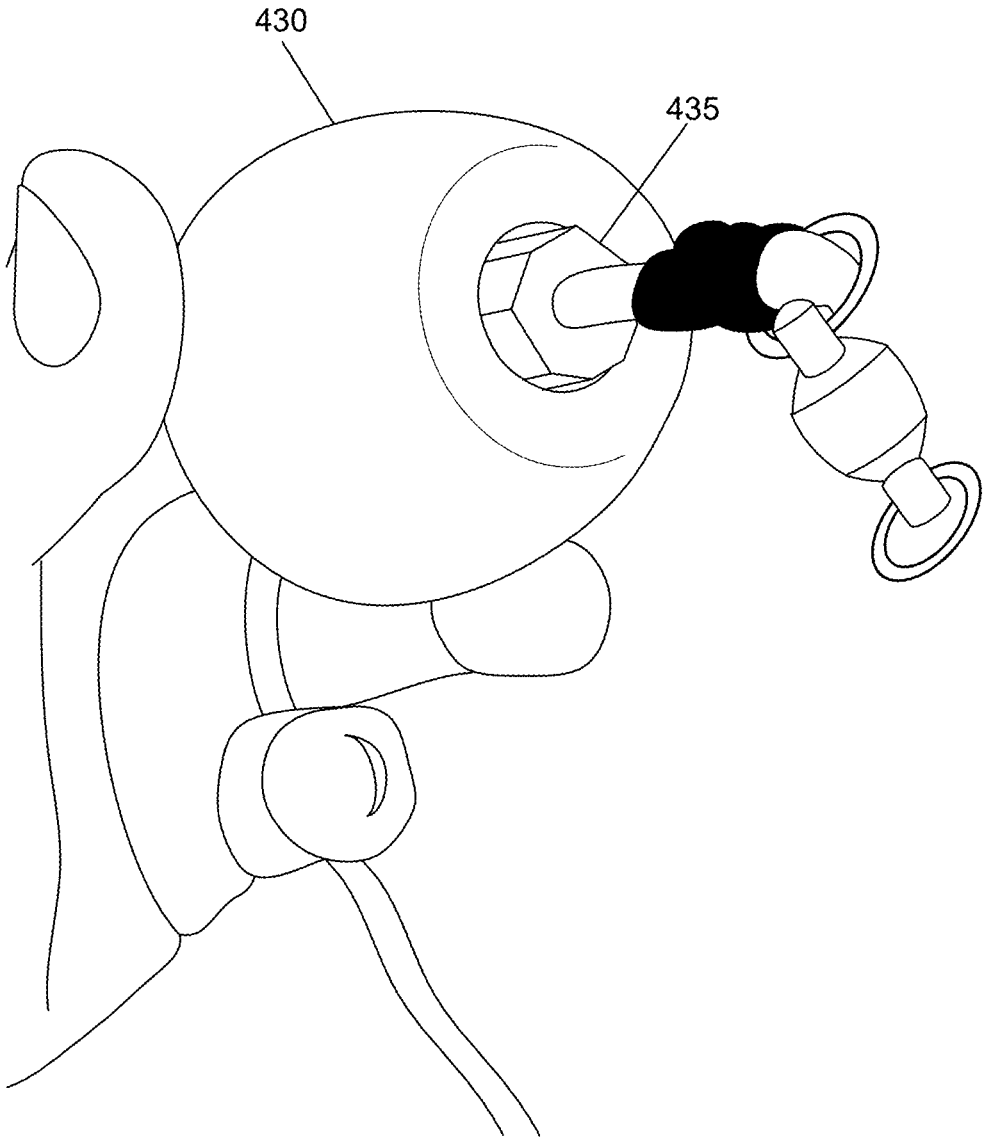
FIG. 4 is a diagram that illustrates a perspective view of the flotation device that is securely attached to the tool lanyard, according to some implementations.

FIG. 4 is a diagram that illustrates a perspective view of the flotation device that is securely attached to the tool lanyard, according to some implementations. As shown in FIG. 4, a flotation device 430 includes a cylindrical hole through which a shock cord of the tool lanyard is placed. Each end of the flotation device 430 is sealed using a plug, such as a neoprene plug 435 depicted in FIG. 4. Desirably, the neoprene plugs create an airtight seal such that the flotation device 430 successfully traps air when the flotation device 430 is submerged. The resulting trapped air weighs less than the weight of water displaced by the trapped air, causing the water to push the flotation device 430 up when placed inside the water.

Figure 5:
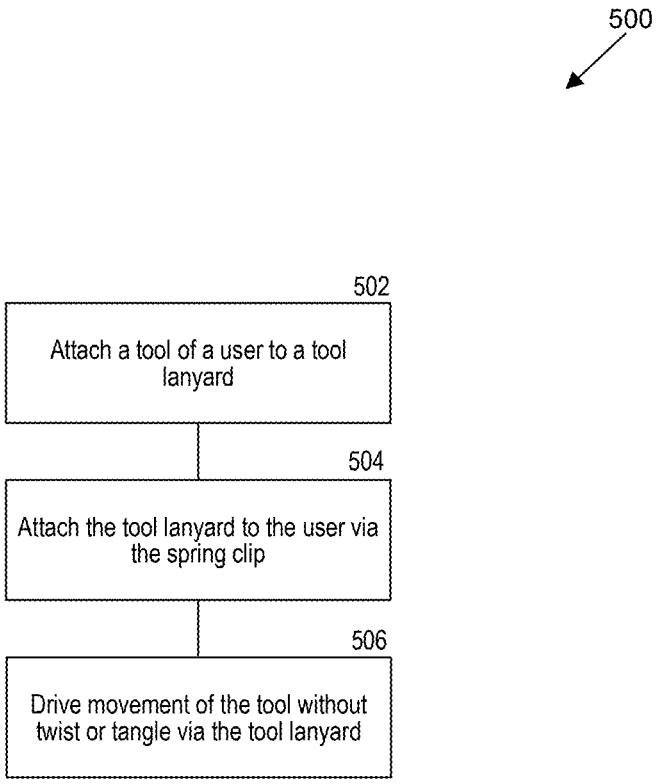
FIG. 5 is a flowchart representation of an example process for securing a tool in position using a tool lanyard in accordance with one or more embodiments of the present technology.

FIG. 5 is a flowchart representation of an example process 500 for securing a tool in position using a tool lanyard in accordance with one or more embodiments of the present technology. At Operation 502, a tool of a user is attached to the tool lanyard. In an example aspect, the tool lanyard includes a shock cord having a first end and a second end. The tool lanyard also includes a spring clip configured to attach to the shock cord via a first hollow opening of the first end of the shock cord, wherein the spring clip enables securing the tool lanyard to a loop. The tool lanyard also includes a swivel with a first ring and a second ring on each end, wherein the swivel is configured to attach to the shock cord by coupling the first ring to a second hollow opening of the second end of the shock cord. The tool is attached to the tool lanyard via the second ring of the swivel of the tool lanyard.

At Operation 504, the tool lanyard is attached to the user via the spring clip. The spring clip can be secured to any loop, such as a belt loop of the user or a loop in a tool pouch equipped by the user. The spring clip enables efficient attachment and detachment of the tool lanyard.

At Operation 506, the user drives movement of the tool without twist or tangle via the tool lanyard. The shock cord prevents the tool lanyard from twist or tangle and ensures the tool is within reach of the user. In some embodiments, a flotation device is installed to the tool lanyard by placing the shock cord through a cylindrical hole of the flotation device. The flotation device enables the user to access the tool underwater without difficulty. The flotation device ensures the position of the tool attached to the tool lanyard is above a connection point between a spring snap and the user, enabling the user to quickly identify the position of the tool underwater.

While this patent document contains many specifics, these should not be construed as limitations on the scope of any invention or of what may be claimed, but rather as descriptions of features that may be specific to particular embodiments of particular inventions. Certain features that are described in this patent document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the embodiments described in this patent document should not be understood as requiring such separation in all embodiments.

Only a few implementations and examples are described and other implementations, enhancements and variations can be made based on what is described and illustrated in this patent document.

What is claimed is:

1. A tool lanyard for securing a tool in position while preventing twist and tangle during use, the tool lanyard comprising:

a shock cord having a diameter of at least 3/16 inches to resist twisting during manipulation of the tool and having a first end and a second end, wherein the shock cord is configured to extend when one end is stretched from another end and return to original length upon release, wherein the first end of the shock cord is folded back on itself to form a first loop, and a first stainless-steel hog ring is crimped around overlapping portions of the shock cord to secure the first loop, and wherein the second end of the shock cord is folded back on itself to form a second loop, and a second stainless-steel hog ring is crimped around the overlapping portions of the shock cord to secure the second loop;

a spring clip configured to attach to the shock cord by passing through the first loop, wherein the spring clip enables securing the tool lanyard to a loop; and a ball-bearing swivel with a first ring and a second ring on each end, wherein the ball-bearing swivel provides multi-axis rotation to enable the tool to rotate freely in multiple orientations without transmitting rotational force to the shock cord, thereby preventing twist and tangle of the tool lanyard, wherein the ball-bearing swivel is configured to attach to the shock cord by the first ring passing through the second loop, and wherein the tool is configured to be secured to the tool lanyard via the second ring; and a flotation device enabling flotation of the tool lanyard and preventing the tool from sinking when submerged in liquid, the flotation device comprising a hollow channel through which the shock cord is threaded, wherein an inner diameter of the flotation device is sized to allow the flotation device to be slidably repositioned along the shock cord to adjust the position of the flotation device between the first end and the second end flotation device to enable adjustment of buoyancy distribution of the tool lanyard.

2. The tool lanyard of claim 1, wherein the shock cord comprises a marine grade shock cord.

3. The tool lanyard of claim 1, wherein a length of the shock cord is between 18 and 28 inches.

4. The tool lanyard of claim 1, wherein the ball-bearing swivel comprises stainless steel.

5. The tool lanyard of claim 1, wherein the spring clip comprises stainless steel.

6. The tool lanyard of claim 1, wherein the flotation device further includes a neoprene plug installed at each end of the hollow channel to prevent flow of water inside the flotation device.

7. The tool lanyard of claim 1, wherein the first and second rings on each end of the ball-bearing swivel are split rings.

8. The tool lanyard of claim 1, wherein the first and second ends of the shock cord are at least partially covered by an adhesive shrink wrap.

9. The tool lanyard of claim 1, wherein the tool is a metal detector pinpointer.

10. A method to secure a tool in position using a tool lanyard preventing twist and tangle during use, the method comprising:

attaching the tool of a user to the tool lanyard, wherein the tool lanyard comprises:

a shock cord having a diameter of at least 3/16 inches to resist twisting during manipulation of the tool and having a first end and a second end, wherein the shock cord is configured to extend when one end is stretched from another end and return to original length upon release, wherein the first end of the shock cord is folded back on itself to form a first loop, and a first stainless-steel hog ring is crimped around overlapping portions of the shock cord to secure the first loop, and wherein the second end of the shock cord is folded back on itself to form a second loop, and a second stainless-steel hog ring is crimped around the overlapping portions of the shock cord to secure the second loop;

a spring clip configured to attach to the shock cord by passing through the first loop, wherein the spring clip enables securing the tool lanyard to a user; and a ball-bearing swivel with a first ring and a second ring on each end, wherein the ball-bearing swivel provides multi-axis rotation to enable the tool to rotate freely in multiple orientations without transmitting rotational force to the shock cord, thereby preventing twist and tangle of the tool lanyard, wherein the ball-bearing swivel is configured to attach to the shock cord by the first ring passing through the second loop, and wherein the tool is attached via the second ring of the ball-bearing swivel of the tool lanyard; a flotation device enabling flotation of the tool lanyard and preventing the tool from sinking when submerged in liquid, the flotation device comprising a hollow channel through which the shock cord is threaded, wherein an inner diameter of the flotation device is sized to allow the flotation device to be slidably repositioned along the shock cord to adjust the position of the flotation device between the first end and the second end to enable adjustment of buoyancy distribution of the tool lanyard;

attaching the tool lanyard to the user via the spring clip; and driving movement of the tool without twist or tangle via the tool lanyard.

11. The method of claim 10, further comprising:

installing the flotation device to the tool lanyard by placing the shock cord through a cylindrical hole of the flotation device.

* * * * *